US005755595A

United States Patent [19]

Davis et al.

[11] Patent Number: 5,755,595

[45] Date of Patent: May 26, 1998

[54] SHIELDED ELECTRICAL CONNECTOR

[75] Inventors: Wayne Samuel Davis; Leung Man Shiu, both of Harrisburg, Pa.

[73] Assignee: Whitaker Corporation, Wilmington, Del.

[21] Appl. No.: 672,152

[22] Filed: Jun. 27, 1996

[51] Int. Cl.[6] ..... H01R 13/648

[52] U.S. Cl. ..... 439/607; 439/609

[58] Field of Search ..... 439/607, 609, 439/78, 79, 92, 101, 329, 567

[56] References Cited

U.S. PATENT DOCUMENTS

| | | | |
|---|---|---|---|
| 4,708,412 | 11/1987 | Himes, Jr. et al. | 439/95 |
| 4,842,554 | 6/1989 | Cosmos et al. | 439/609 |
| 4,842,555 | 6/1989 | Cosmos et al. | 439/609 |
| 4,938,704 | 7/1990 | Fujiura | 439/95 |
| 5,017,156 | 5/1991 | Sugiyama | 439/607 |
| 5,030,140 | 7/1991 | Sugiyama | 439/607 |
| 5,073,130 | 12/1991 | Nakamura | 439/607 |
| 5,083,945 | 1/1992 | Miskin et al. | 439/607 |
| 5,207,597 | 5/1993 | Kline et al. | 439/607 |
| 5,254,010 | 10/1993 | Davis | 439/108 |
| 5,266,038 | 11/1993 | Nakamura | 439/79 |
| 5,267,882 | 12/1993 | Davis | 439/680 |
| 5,378,172 | 1/1995 | Roberts | 439/607 |
| 5,409,400 | 4/1995 | Davis | 439/610 |
| 5,429,520 | 7/1995 | Morlion et al. | 439/108 |
| 5,496,195 | 3/1996 | Reed | 439/607 |
| 5,518,421 | 5/1996 | Davis | 439/607 |

OTHER PUBLICATIONS

U.S. Patent Application Serial No. 08/629,485, filed Apr. 10, 1996 (Abstract and Drawings only included).

U.S. Patent Application Serial No. 08/653,144, filed May 24, 1996 (Abstract and Drawings only included).

*Primary Examiner*—Khiem Nguyen

*Attorney, Agent, or Firm*—Anton P. Ness

[57] ABSTRACT

Connector (10) includes a shell (14) having a forward end (18) exposing a mating face of an insulative housing (12) for mating. Shell (14) is stamped and formed from a blank to define four walls surrounding the housing upon assembly, with an open seam (88) defined in one of the walls by opposed edges of the blank. Tabs (60) of the shell adjacent the one wall extend toward each other from edges of the adjacent shell walls, and include end portions bent inwardly toward the housing to be seated within slots (62) in the housing, holding the adjacent shell walls against the housing and preventing inadvertent opening of the seam (88).

3 Claims, 4 Drawing Sheets

SHIELDED ELECTRICAL CONNECTOR

FIELD OF THE INVENTION

This relates to the field of electrical connectors and more particularly to connectors having shields therearound.

BACKGROUND OF THE INVENTION

Electrical connectors are known that include shields therearound for protection against transmission and reception of electromagnetic interference. In U.S. patent application Ser. No. 08/629,485 filed Apr. 10, 1996 and assigned to the assignee hereof, a connector is disclosed having a shield member therearound and is mountable to a circuit board for placement at an input/output port of an electronic apparatus such as a computer. The input/output port is an aperture through a conductive panel member of the apparatus. Preferably the shield of the connector is in electrical engagement with the conductive panel to define a chassis ground, after mounting of the connector.

It is desired to provide for assured attachment of the shield member to the insulative housing.

SUMMARY OF THE INVENTION

The present invention provides assured attachment of the shell to the insulative housing therewithin, where the shell is fabricated by a stamping and forming procedure from an integral blank stamped from a sheet of metal. Such a shell is formed to surround the insulative housing and results in a seam defined between the opposed edges of the blank prior to forming, with the seam lying in one of the shell walls after forming. As an alternative to soldering or welding the seam at one or more locations, the present invention provides tabs defined adjacent the opposed edges of the blank that include inwardly directed end portions to seat within slots of the insulative housing upon assembly of the housing within the conductive shell, with the tabs extending from edges of the walls adjacent the shell wall containing the seam.

An embodiment of the present invention will now be described by way of example with reference to the accompanying drawings.

DETAILED DESCRIPTION

Figure 1:
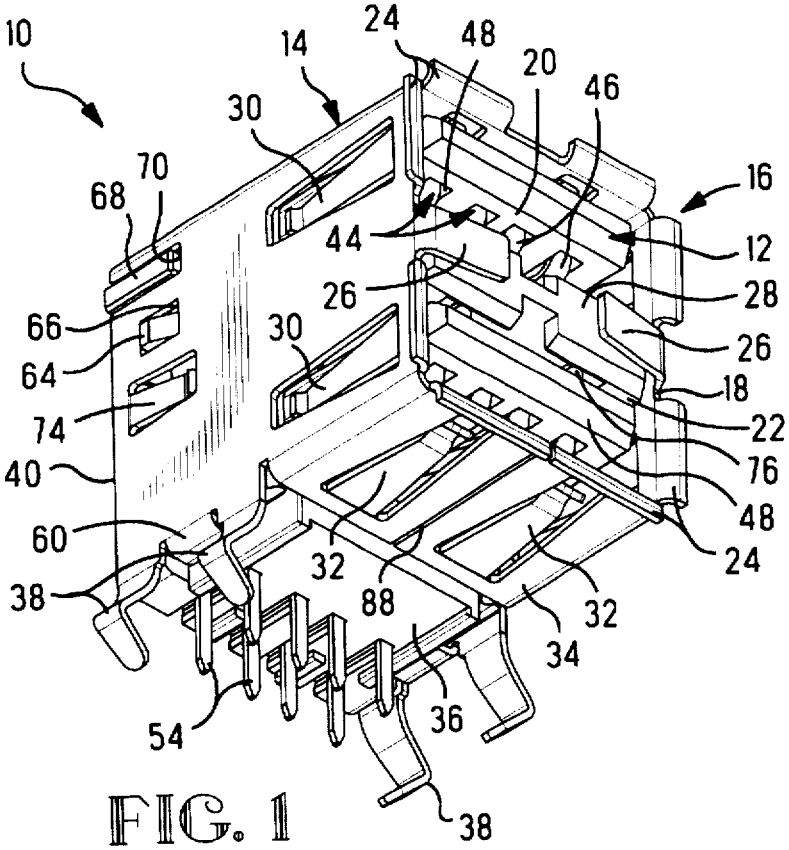
FIG. 1 is an isometric view of the connector of the present invention.
Figure 2:
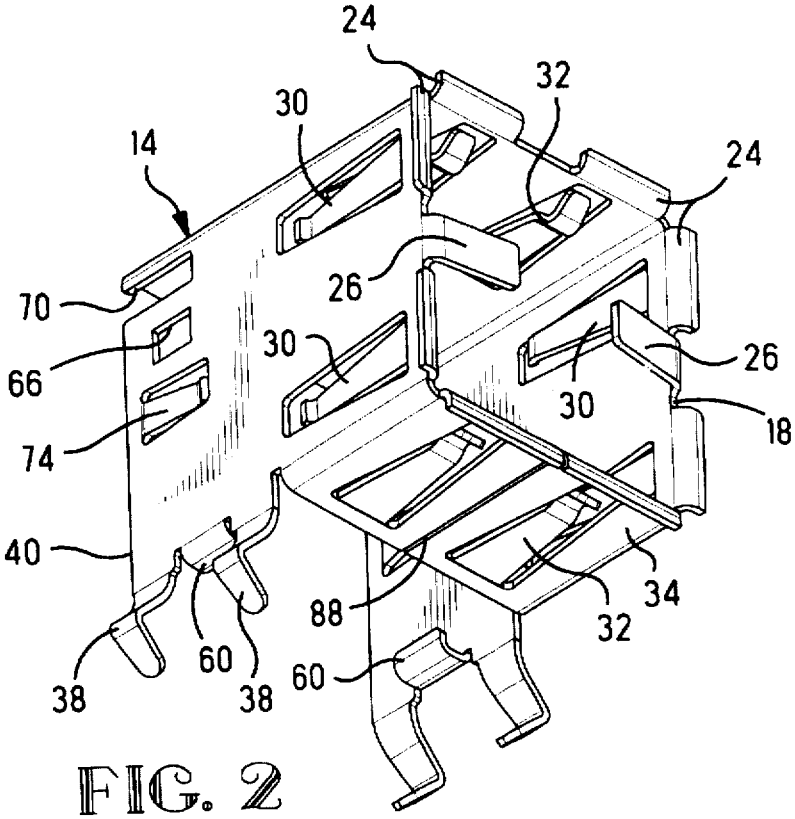
FIGS. 2 and 3 are isometric views of the shield member and the housing member, respectively, of the connector of FIG. 1.
Figure 3:
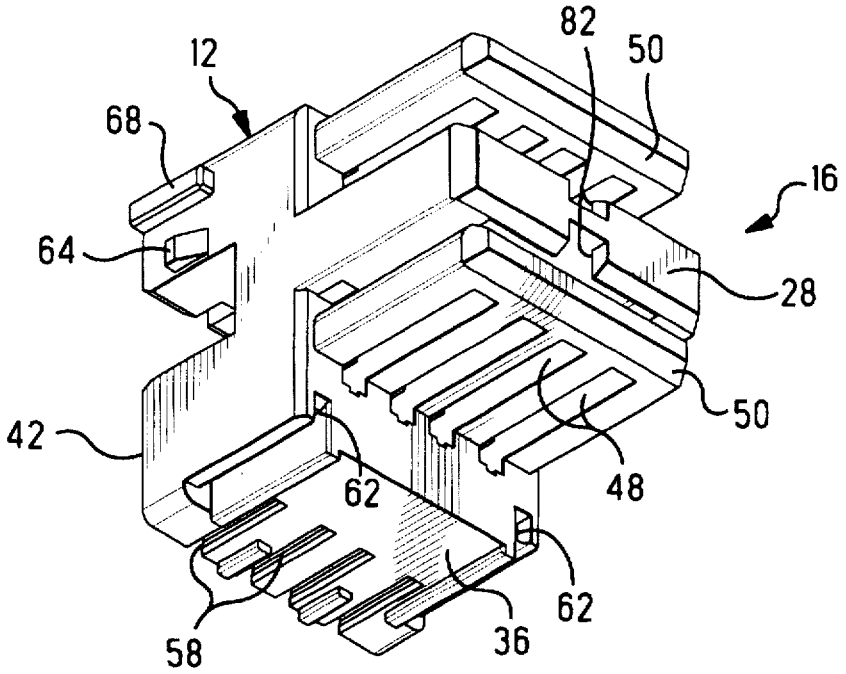

Connector 10 in FIGS. 1 to 4 includes an insulative housing 12 disposed within a conductive shell 14 that defines an EMI shield. Mating face 16 is exposed by forward end 18 of shell 14 for mating, and is shown to define two plug-receiving cavities 20, 22. Shell 14 includes an array of short arcuate flanges 24 about the periphery of the mating face and is further shown to include a pair of elongate tabs 26 angled forwardly and toward each other from opposed sides of forward end 18, forwardly of and aligned with the central wall 28 of housing 12 between cavities 20, 22. Also shown are spring arm contact sections 30 extending rearwardly and inwardly into the cavities for free ends thereof to engage the corresponding shields of the mating plugs (not shown); and retention arms 32 extending forwardly and into the cavities for free ends to seat within recesses in the side walls of the mating plugs to maintain the connectors in a mated condition.

Figure 4:
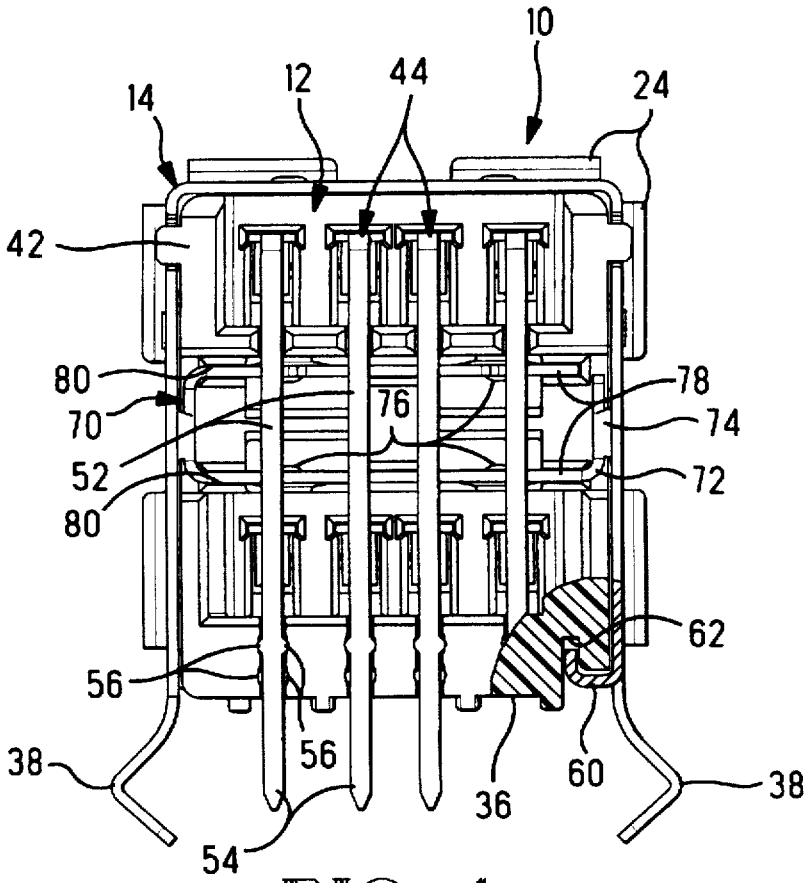
FIG. 4 is an elevation view of the rear face of the connector of FIG. 1.

Shell 14 also includes a bottom end 34 surrounding board-mounting face 36 of housing 12, and further includes an array of board-retention legs 38 adapted to cooperate with mounting holes of a circuit board (not shown) on which connector 10 is to be mounted. As seen in FIG. 4, rearward end 40 of shell 14 exposes rear face 42 of the connector housing.

A plurality of contacts 44 is disposed in connector 10 with first contact sections 46 disposed within channels 48 of support walls 50 of housing 12 that are positioned plug-receiving cavities 20, 22. Right-angle legs 52 extend along rear face 42 to second contact sections 54 depending below board-mounting face 36 for electrical connection with circuits of the circuit board. It can be seen that retention embossments 56 generate an interference fit of legs 52 within respective channels 58 extending inwardly from rear face 42 of housing 12 along board-mounting face 36.

Shell 14 is retained onto housing 12 by tabs 60 of along the bottom end 34 of shell 14 being seated within slots 62 of housing bottom 36 to prevent separation of the shell along the seam 88 (FIGS. 1 and 2) resulting from the stamping and forming of shell 14, latches 64 of housing 12 seating within recess 66 of shell 14, and stabilizing rib 68 of housing 12 disposed in recess 70 at shell rear end 40. Tabs 60 extend from edges of the shell side walls adjacent the bottom wall of the shell containing seam 88, toward each other to end portions bent upwardly (toward the top shell wall) to be seated within slots 62 of the housing and can be slid therealong during insertion of the housing into the open rear shell end for assembly.

Figure 5:
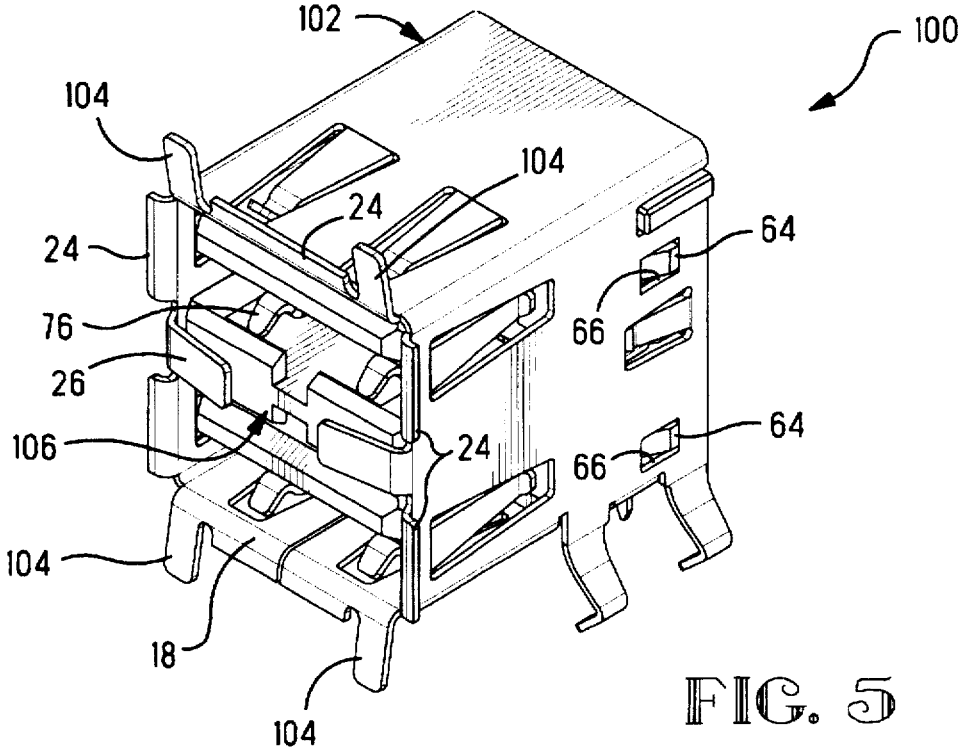
FIGS. 5 and 6 are isometric views of alternate embodiments of connectors of the invention, with FIG. 6 also showing a panel cutout with which the present invention is especially useful.

An inner conductive member or shell 72 is seen in FIG. 4 to be inserted into housing 12, electrically engaged by interconnect arms 74 of shell 14, and provide plug-retention arms 76 (leading ends of which are seen in FIGS. 1 and 5) similar to arms 32 of shell 14. Upper and lower plates 78 are inserted into slots 80 of housing 12 extending forwardly from rear face 42. Retention arms 76 extend forwardly from upper and lower plates 78 of the inner shell member and in recesses 82 of central wall 28, and are disposed on the opposite side of cavities 20, 22 from arms 32 to engage opposite outer surfaces of mating plug connectors inserted into respective cavities 20, 22. Inner shell member 70 is retained within connector 10 such as by rearwardly extending locking lances (not shown) on the upper and lower plates latching forwardly of stop surfaces defined within the body of housing 12 adjacent to slots 80 rearwardly of cavities 20, 22.

Figure 6:
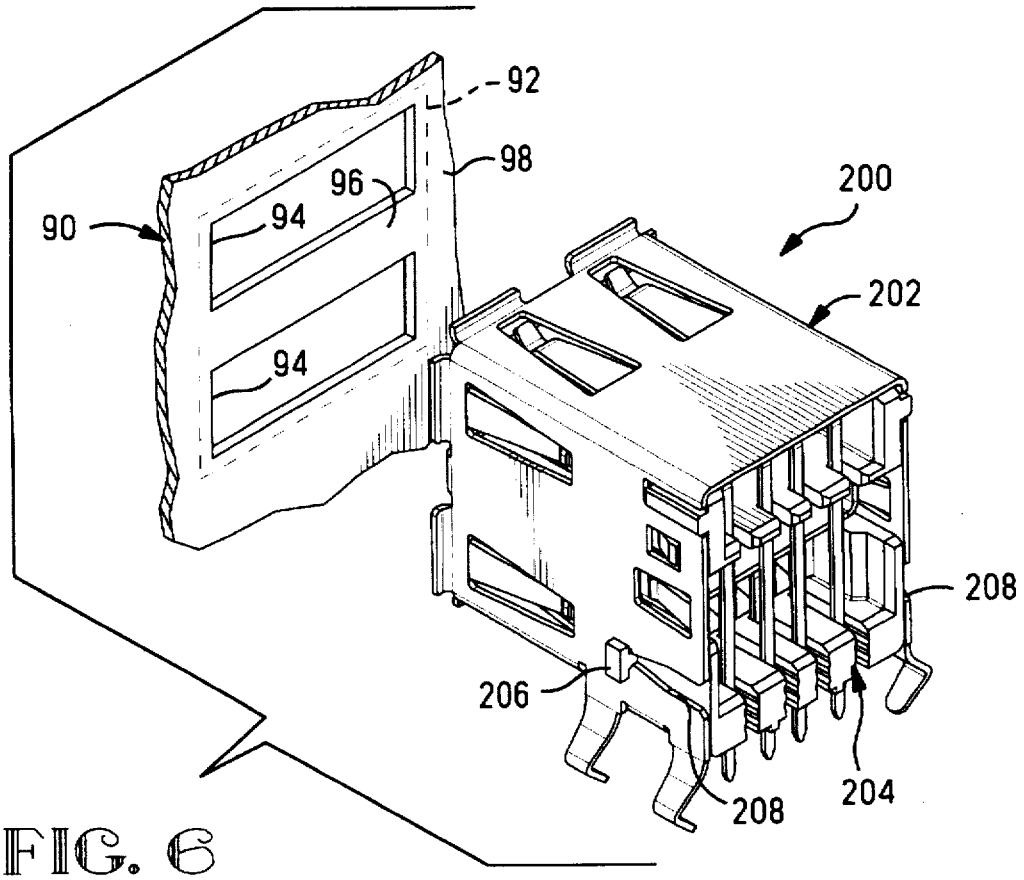

The pair of tabs 26 extend from opposed sides of forward end 18 of shell 14 toward each other and angled forwardly. Tabs 26 are associated with the panel cutout at which connector 10 is mounted in an electronic apparatus such as a computer. A panel 90 with a cutout 92 is shown in FIG. 6 and has cutout portions 94 separated by a strip 96 joining opposed sides of the periphery 98 of the cutout. Upon mounting of the connector at the cutout, plug-receiving cavities 20, 22 are aligned with respective cutout portions 94, flanges 24 abut periphery 98 of cutout 90, and tabs 26 abut strip 96 to establish ground connections intermediate cutout portions 94 for enhanced shielding of the connector at the cutout. The tabs also assure an electrical grounding connection between shell 14 and panel 90 in the event that mounting of the circuit board to which connector 10 is mounted, within the apparatus adjacent cutout 90, results in an incremental spacing between flanges 24 and the panel. Even if flanges 24 are not in engagement with the panel, the flanges provide shielding to substantially close the gap between the cutout periphery and the shell and thus provide substantial shielding benefits, but it is preferable that actual ground engagement be attained between the shell and the panel.

Connector 100 in FIG. 5 illustrates another embodiment of the present invention in which shell 102 includes along forward end 18 thereof, pairs of upper and lower tabs 104 that will engage the panel upon the connector being mounted within an apparatus at the panel cutout. Upper and lower tabs 104 are angled to extend forwardly and outwardly from the connector mating face, similarly to tabs 26. Connector 100 also shows additional latches 64 of housing 106 seated within respective recesses 66, if desired.

In FIG. 6 is shown an additional embodiment of connector 200 having shell 202 enclosing housing 204, wherein a T-shaped projection 206 of housing 204 is shown to extend outwardly to be received into a slot 208 of shell 202. The constriction of the T-shaped projection seats forwardly of barbs of the slot, to retain the projection in position and securing the shell on the housing in a fixed position. T-shaped projections 206 on both sides of the housing assist tabs 60 in slots 62 (FIG. 4) in maintaining the side walls of shell 202 adjacent the side walls of housing 204, with respect to the open seam along the connector bottom resulting from the stamping and forming procedure for fabricating shell 202 (see FIGS. 1 and 2). Alternatively, such protection against inadvertent seam opening can be attained through the use of the T-shaped projections alone.

Figure 7:
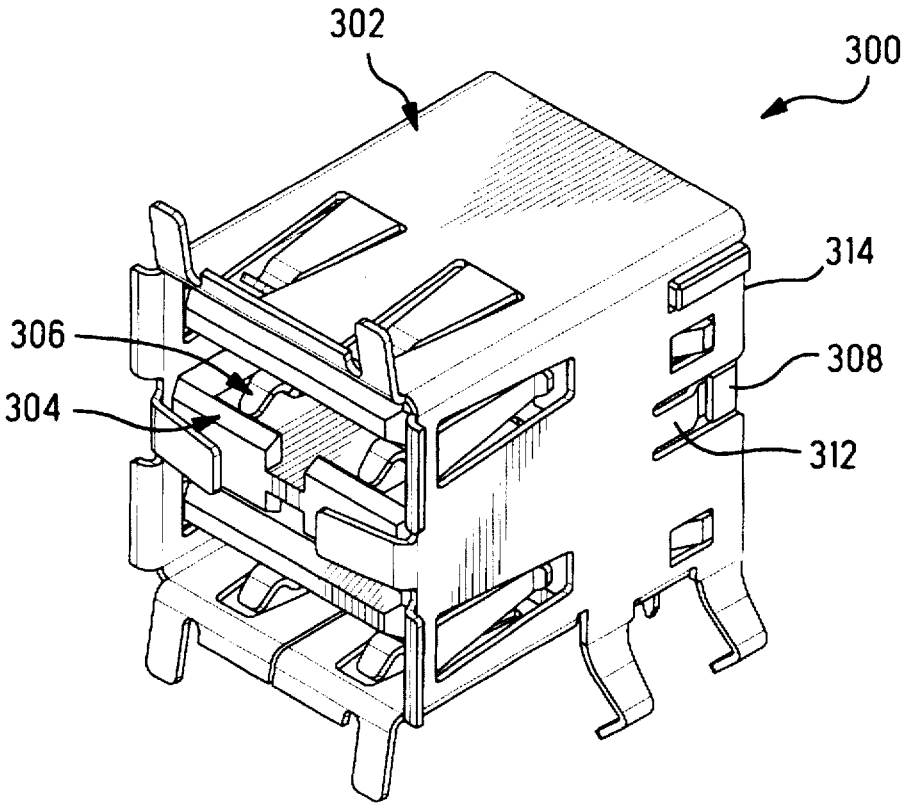
FIGS. 7 and 8 are an isometric and an enlarged part section view of an additional embodiment of the connector of the invention.
Figure 8:
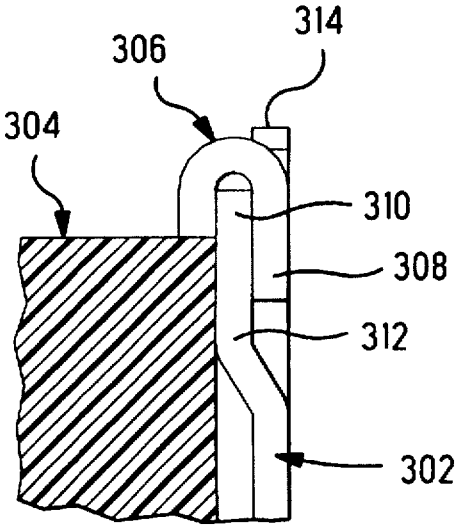

In FIGS. 7 and 8, connector embodiment 300 with shell 302 enclosing housing 304, an alternative manner is shown of establishing the electrical connection between the inner shell member 306 and shell 302. Tab 308 of the inner shell member is clinched around a free end 310 of arm 312 of shell 302 along rear end 314 of shell 302.

Other modifications and revisions may be made to the specific embodiments disclosed herein, that are within the spirit of the invention and the scope of the claims.

What is claimed is:

1. An electrical connector, comprising:

an insulative housing with an array of contact secured therein to extend from a mating face for mating with a complementary connector, to another face for connection to another electrical article, and a conductive shell defined by an integral stamped and formed metal member having a first wall, opposed side walls and a fourth wall, said first wall being defined by a pair of wall portions extending from edges of said opposed side walls to respective opposed wall portion edges proximate each other at a seam, said opposed side walls associated with and adjacent to corresponding side walls of said housing upon assembly of said shell about said housing, said shell including a pair of tabs extending from said edges of opposed side shell walls spaced from said wall portions of said first wall, said tabs first extending toward each other and including end portions extending about bends of about 90 degrees toward said fourth wall, and said housing including slots extending into one of said walls thereof adjacent said first shell wall, said slots being orthogonal to said one of said walls such that said end portions of said pair of tabs extend thereinto upon assembly of said shell about said housing thereby holding said shell side walls adjacent said housing side walls and thereby preventing inadvertent opening of said seam.

2. The electrical connector as set forth in claim 1 wherein said housing includes T-shaped projections extending outwardly from said housing side walls proximate said adjacent one of said housing walls, and said shell includes openings associated with said T-shaped projections such that said T-shaped projections extend through said openings upon assembly of said shell about said housing to hold said adjacent ones of said shell walls adjacent said housing side walls.

3. An electrical connector, comprising:

an insulative housing with an array of contacts secured therein to extend from a mating face for mating with a complementary connector, to another face for connection to another electrical article, and a conductive shell defined by an integral stamped and formed metal member having at least a pair of opposed edges proximate each other at a seam, to include walls associated with and adjacent to corresponding walls of said housing upon assembly of said shell about said housing, with said seam disposed in one of said shell walls, said housing includes T-shaped projections extending outwardly from said corresponding ones of said housing walls proximate said adjacent one of said housing walls, and said shell includes openings associated with said T-shaped projections such that said T-shaped projections extend through said openings upon assembly of said shell about said housing to hold said adjacent ones of said shell walls adjacent said corresponding ones of said housing walls, thereby preventing inadvertent opening of said seam.

* * * * *